United States Patent [19]

Oldweiler

[11] 4,411,769

[45] Oct. 25, 1983

[54] INTEGRATED TWO STAGE COKING AND STEAM CRACKING PROCESS AND APPARATUS THEREFOR

[75] Inventor: Morey E. Oldweiler, Chester, N.J.

[73] Assignee: Exxon Research & Engineering Co., Florham Park, N.J.

[21] Appl. No.: 360,927

[22] Filed: Mar. 23, 1982

[51] Int. Cl.[3] ..... C10G 9/32

[52] U.S. Cl. ..... 208/54; 208/127; 422/14 D

[58] Field of Search ..... 208/480, 127, 153, 164, 208/54; 48/206

[56] References Cited

U.S. PATENT DOCUMENTS

| | | | |
|---|---|---|---|
| 2,589,124 | 3/1952 | Packie | 196/52 |
| 2,763,601 | 9/1956 | Martin et al. | 208/480 |
| 2,793,173 | 5/1957 | Fritz | 208/127 |
| 2,846,360 | 8/1958 | Jahniq | 196/49 |
| 2,859,168 | 11/1958 | Downing et al. | 208/48 |
| 2,871,183 | 1/1959 | Smith et al. | 208/54 |
| 2,881,130 | 4/1959 | Pfeiffer et al. | 208/127 |
| 2,943,993 | 7/1960 | Sykes | 208/48 |
| 3,414,504 | 12/1968 | Oldweiler | 208/127 |
| 3,592,762 | 7/1971 | Blaser et al. | 208/127 |
| 3,641,190 | 2/1972 | Kivlen et al. | 260/683 |
| 3,661,543 | 5/1972 | Saxton | 48/206 |
| 3,661,767 | 5/1972 | Wirth et al. | 208/127 X |
| 3,816,084 | 6/1974 | Moser, Jr. et al. | 208/127 X |
| 4,055,484 | 10/1977 | Blaser et al. | 48/206 X |
| 4,061,562 | 12/1977 | McKinney et al. | 208/127 X |
| 4,203,759 | 5/1980 | Metrailer et al. | 48/206 X |
| 4,213,848 | 7/1980 | Saxton | 208/127 |
| 4,269,696 | 5/1981 | Metrailer | 208/127 X |
| 4,297,202 | 10/1981 | Blaser | 208/127 X |
| 4,331,529 | 5/1982 | Lambert et al. | 48/206 X |

FOREIGN PATENT DOCUMENTS 1077918 11/1965 United Kingdom .

OTHER PUBLICATIONS

U.S. Ser. No. 272,503 (filed 6/11/81).

*Primary Examiner*—Delbert E. Gantz
*Assistant Examiner*—Glenn Caldarola
*Attorney, Agent, or Firm*—Rebecca Yablonsky

[57] ABSTRACT

The invention relates to an improvement in an integrated, two stage coking and steam cracking process for the production of unsaturated light hydrocarbons. A heavy hydrocarbonaceous oil is first coked in a fluidized bed coking zone. The vaporous conversion product is passed to a dilute phase. High temperature cracking in the presence of steam is carried out on the vaporous coker conversion product by injecting into the vapors a stream of hot coke particles at a sufficient temperature and in sufficient amount to raise the coker vapors to steam cracking temperature and supply the endothermic heat of reaction. Solids are separated from product gas in a gas-solids separation zone such as one or more cyclones and sent to the fluid coking zone and the gas is quenched to stop olefin degradation reactions. According to the improvement, relatively low temperature steam is introduced into contact with the separated solids to superheat the steam and cool the solids. Suitably this is effected in a riser on the cyclone dipleg. The solids, after having given up heat to the steam, pass into the coking zone and the superheated steam passes into the dilute phase and serves as part of the dilution steam therefor. Conservation of fuel and mitigation of coke on reactor walls and equipment are advantages of the process.

9 Claims, 2 Drawing Figures

INTEGRATED TWO STAGE COKING AND STEAM CRACKING PROCESS AND APPARATUS THEREFOR

FIELD OF THE INVENTION

This invention relates to an integrated, two stage coking and steam cracking process (cocracking) and apparatus for the production of products including unsaturated light hydrocarbons, particularly $C_2$–$C_4$ olefins and diolefins, and aromatics, useful as chemicals and chemical intermediates.

BACKGROUND OF THE INVENTION

Steam cracking is a well-known process and is described in U.S. Pat. No. 3,641,190 and British Pat. No. 1,077,918, the teachings of which are hereby incorporated by reference. In commercial practice, steam cracking is carried out by passing a hydrocarbon feed mixed with 20–90 mol % steam through metal pyrolysis tubes located in a fuel fired furnace to raise the feed to cracking temperatures, e.g., about 1400° to 1700° F. and to supply the endothermic heat of reaction.

The fluid coking process for the production of fuels, such as gas oil and naphtha is well known and is disclosed in U.S. Pat. No. 2,881,130, the teachings of which are hereby incorporated by reference. Integrated fluid coking and coke gasification processes are also known and disclosed, for example, in U.S. Pat. Nos. 3,661,543 and 3,816,084, the teachings of which are hereby incorporated by reference.

Fluid coking processes for the production of chemicals and chemical intermediates are also known, see, for example, U.S. Pat. Nos. 2,846,360 and 2,871,183. Generally, when it was desired to produce chemicals rather than fuel oils, heretofore, the fluid coking process usually included a high temperature transfer line cracking zone and a fluidized bed coking zone.

It is also known to introduce a small amount of hot solids into a gas-solids separation zone, such as the cyclone separator, used to separate entrained solids from the vaporous coker product, so as to prevent coke deposition on the walls of the cyclone separator, see for example, U.S. Pat. Nos. 2,763,601; 2,859,168 and 2,943,993. This treatment is known as scouring. For scouring coke the amount of heat to be added need only be enough to uphold the temperature of the vapors and prevent them from depositing coke whereas the heat load is much greater for steam cracking.

The present process relates to and is an improvement on U.S. Pat. No. 4,297,202. This application also relates to U.S. Ser. No. 272,503 filed on June 11, 1981.

In cocracking, a carbonaceous material is coked in a first stage fluid coking zone and the resulting vaporous coker conversion product is passed to a second stage reaction zone where it is heated in the presence of steam to a temperature adapted to crack the same to products including low molecular weight unsaturated hydrocarbons. This is achieved by injecting a stream of hot solids at a sufficiently high temperature and in sufficient amount into the vaporous coker conversion product passing to a gas-solids separation zone such as the cyclone separator. The hot solids may be supplied by a coke gasification zone.

In cocracking there are two stages in the reactor, which are operated at different temperatures and which accomplish different purposes, viz., coking and steam cracking. These two stages are carried out in the same environment and in close proximity to each other. The first stage is suitably carried out in a large fluidized bed of solids which is fed a preheated coking feed, typically a vacuum residuum. The second stage is suitably effected in a smaller, dilute phase which is fed vapor from the first stage. The main flow of solids which supplies heat for both stages, flows counter-current to the flow of hydrocarbon feed.

Although the temperatures for the two stages are disparate, it was found that these two reactions can be coordinated and caused to take place in the same vessel.

This problem of temperature control is more acute when high flow rates of heat-carrying solids to the dilute phase are used in order to reach the preferred, higher than minimal steam cracking temperatures, inasmuch as these solids—after heat exchange with the coking vapors and separation from product gas in the gas-solids separation zone—normally pass into the coking zone and could heat the latter excessively.

One way of maintaining suitable temperatures in the coking zone involves injecting water into the bed to lower and control bed temperature. In the following discussion it will be useful to consider this as the base case. However, this is not an efficient use of heat. Also, the reactor vapors from the bed have a tendency to cause coke build-up on the walls and equipment in the dilute phase because the vapors are at their dew point.

The subject invention provides a novel technique and apparatus to establish and control the temperatures of the two zones and alleviate both of these problems.

SUMMARY OF THE INVENTION

According to the invention, vapor risers are provided on the cyclone diplegs and steam is injected into the upflow part of the risers. Thus, a portion of the dilution steam required in the second stage is introduced directly into that stage and used as the lift gas on the riser. The coke from the cyclone diplegs undergoes heat exchange with the injected steam: the coke is cooled and the steam is superheated, then passes into the second stage dilute phase and mixes with the materials there. This results in a saving of heat because those materials are thus heated above the temperature of the coking zone whereas in the base case the hot coke from the gasifier has to raise the said materials over the entire temperature delta between the coking zone and the steam cracking reaction zone. That is to say, in the base case operation, the coke falling into the coking zone from the gas-solids separation zone is cooled to bed temperature by water injection and the steam passing from the bed into the dilute phase has to be heated to cracking temperature. Thus all of the dilution steam for the dilute phase would have to be heated over the entire temperature gradient between the two stages, by heat supplied from another source, viz., by hot solids from the gasifier, which consumes fuel. Whenever heat contained in a reactor can be used internally, as against using an outside source of fuel like solids from the gasifier, the reactor is more fuel efficient.

Since the gasifier solids have to supply heat to the coke entrained from the bed and any steam passing from the bed into the dilute phase in addition to the hydrocarbon vapors (since all must be brought up to steam cracking temperature) further advantages accrue by using the present invention. Reducing water to the bed reduces the volume of gas flow leaving the bed. This lowers entrainment of coke, and reaction diameter. Both the reduced entrainment of coke and the superheating of injected steam in the risers, reduce the heat requirement or heat load on the second stage.

The attachment of risers to the cyclone diplegs and injection of steam thereinto is advantageous because this arrangement provides a high concentration of the separated hot coke for contact with the relatively low temperature steam, uses the steam for an additional purpose, e.g., aslift gas, and does not interfere with the normal separation of solids from gas in the cyclones and flow of solids through the diplegs. However, if desired, other mechanical devices may be used for contacting hot coke which has already participated in the steam cracking reaction, with the relatively low temperature injected steam.

The hydrocarbon partial pressure (HCPP) of the vapors emanating from the bed is reduced as a result of dilution with the dipleg riser steam. The increased temperature and reduced HCPP will eliminate coking in the dilute phase upstream of the second stage by preventing condensation of heavy hydrocarbons. This is due to the lower maximum end boiling point of the vapors from the bed compared to the base case and the reduction in dew point of the vapors after dilution with hot steam. The lower end point of residual feed components will also reduce formation of condensible components in the second stage which will reduce coking tendencies in the cyclone outlet piping.

Therefore, according to the present invention, some of the dilution steam required for the second stage of cracking is superheated by use in a riser on the cyclone diplegs. This improvement heats the dilute phase vapor thereby reducing fouling in the dilute phase and lowers heat requirements as a result of reducing or eliminating water injection to the bed.

In the overall process, a carbonaceous feed is passed to the reactor into a coking zone containing a fluidized bed of solids above which there is a dilute phase. A stream of solids having coke deposited thereon is withdrawn from the lower portion of the reactor and passed to a heater in which a fluidized bed of such solids is maintained. A portion thereof is passed to a gasifier having a gasification zone also containing a fluidized bed. In the gasification zone, some coke is burned with steam and oxygen to produce a hydrogen and carbon monoxide fuel gas and to heat the remaining solids. The reactions which may take place are more fully described in U.S. Pat. No. 3,661,543. The fuel gas may be introduced into the heater fluidized bed. The gaseous effluent of the heater, including entrained solids, passes through a gas-solids separator which may be one or more cyclones and the heater gaseous effluent is recovered as a fuel gas. Steam cracking is effected by withdrawing a stream of hot solids from the gasifier and injecting it into the dilute phase above the dense fluid bed in the reactor. As described above, the hot solids, after heat exchange with the vaporous coking zone conversion product and separation from product gas in the gas-solids separator, are brought into contact and heat exchanged with relatively low temperature dilution steam supplied for the second stage of cracking, before passing into the coking zone.

DETAILED DESCRIPTION

Figure 1:
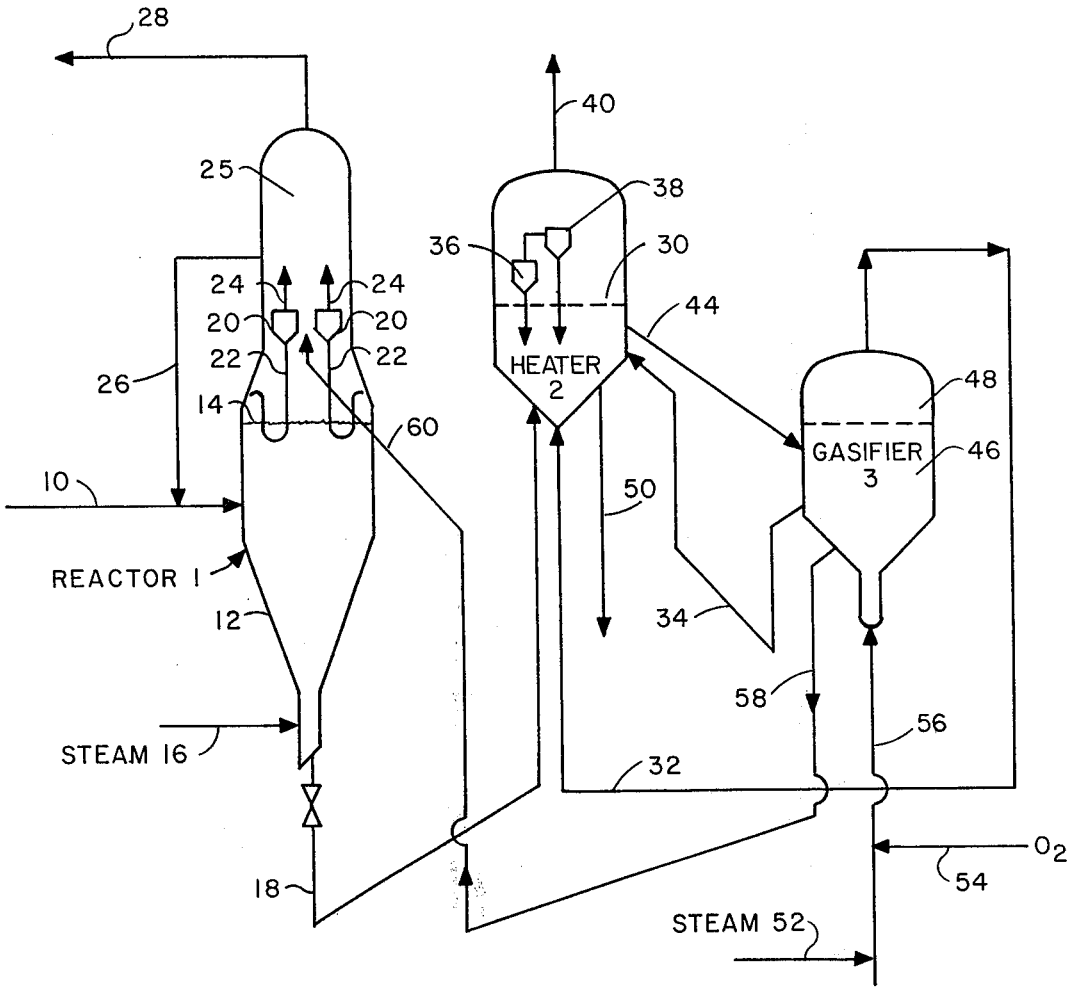
FIG. 1 is a schematic flow plan of one embodiment of the invention.

Referring to FIG. 1, a carbonaceous material for example having a Conradson carbon residue of about 25 weight percent such as heavy residuum having a boiling point (at atmospheric pressure) of about 1050° F.+ is passed by line 10 to reactor 1 into a coking zone 12 in which is maintained a fluidized bed of solids (e.g., coke particles of 20 to 1000 microns in size) having an upper level indicated at 14 above which there is a disperse or dilute phase. Carbonaceous feeds suitable for the present invention include heavy hydrocarbonaceous oils; heavy and reduced petroleum crudes; petroleum atmospheric distillation bottoms; petroleum vacuum distillation bottoms; pitch, asphalt, bitumen, other heavy hydrocarbon residues; coal in comminuted form; coal slurry; liquid products derived from coal liquefaction processes and mixtures thereof. Typically such feeds have a Conradson carbon residue of at least 10 weight percent, generally from about 10 to about 50 weight percent (as to Conradson carbon residue, see ASTM test D-189-65). Reactor 1 may be lined internally with a refractory insulating material, not shown. A fluidizing gas, e.g., steam, is admitted at the base of coking reactor 1 through line 16 in an amount sufficient to obtain superficial fluidizing gas velocity in the range of 0.5 to 5 feet per second.

The coking temperature is in the range of about 950° to about 1150° F., preferably about 950° to about 1100° F., more preferably about 950° to about 1050° F. The pressure in the coking zone is maintained in the range from about 5 to about 150, preferably about 5 to about 45 psig. The lower portion of the coking reactor serves as a stripping zone to remove occluded hydrocarbons from the coke. A stream of coke is withdrawn from the stripping zone by line 18 and circulated to heater 2. A gas-solids separation zone such as cyclones 20 serves to remove entrained solids from vaporous products. The cyclone separator system may be one or more cyclones. A baffle 62 (refer to FIG. 2) extends from the sides of the reactor 1 above the fluid bed and terminates in a relatively small diameter top which defines a restricted vapor passageway or duct 66 for the vapors from the fluid bed to the inlet 64 of the cyclones.

Cracking takes place in the duct 66 and in the cyclones. The temperature in the cracking zone is maintained in the range of 1200° to 1700° F., preferably about 1300° to about 1500° F., to convert at least a portion of the coking zone conversion product, preferably at least 15% thereof, to lower olefins and diolefins. This is accomplished by introducing a sufficient amount of a stream of hot solids, withdrawn from the gasifier 3 by line 58 and then injected by line 60 above the dense fluid bed, into the dilute phase in the duct 66 leading to the inlet of the cyclones. The zone between the outlet of the hot solids feed line 60 and the cyclone inlet should be as short as possible to keep residence time low (for good selectivity to $C_2$–$C_4$ olefins) but long enough to ensure good mixing and heat transfer between the coke and the gas. Gas residence time in this zone will typically be 0.02 to 0.3 seconds, preferably 0.05 to 0.2 seconds. The amount of solids is in the range of about 1000 to 2500 lbs., preferably about 1200 to 2000 lbs. per barrel of fresh feed and they are at a temperature in the range of 1500° to 2000° F., preferably 1600° to 1800° F.

Residence time of the coker vapors at steam cracking conditions, i.e., from the point of injection of the coke to the outlet of the cyclone is approximately one second or less, e.g., 0.2 to 0.8 seconds. The resulting vapor/coke product mixture is separated in the cyclones, the coke passing down into the diplegs 22. The coke separated by the cyclones is preferably at a temperature of about 1300° to about 1500° F.

The apparatus provides means for contacting coke from the diplegs with injected steam in order to superheat the steam. Various mechanical configurations may be used to achieve the objectives of this invention. The following illustrates one such configuration.

A riser 4 is connected to the cyclone dipleg 22 of at least one cyclone so as to receive separated solids therefrom. The riser has an upflow portion 5 and a downflow portion 6. Steam may be injected into the upflow portion of the riser via a line 7 at a point such that a fluidized coke seal is provided in the bottom of the bend to prevent steam flow up the dipleg and that the coke level in the dipleg will be in the normal range. The exit 8 of the riser is located near the wall of the reactor and directs the vapor and coke either tangentially to the wall or downwardly so as to assist in separation of the coke and steam.

The operation of the dipleg-riser arrangement is in principle similar to that described for standpipes in U.S. Pat. Nos. 2,881,130 and 2,589,124, incorporated herein by reference. Briefly, the circulation of solids from the dipleg into the riser thence into the dilute phase is accomplished by maintaining a relatively low density in the riser pipe 4 and relatively high density in the dipleg 22 so that the head of pressure at the base of the dipleg serves as a driving force to circulate the solids through the riser 4, from which they exit into the dilute phase above the level 14. Density in the riser depends on the amount of steam injected. The coke solids then pass into the coking zone 12. The superheated steam passes into the dilute phase.

Figure 2:
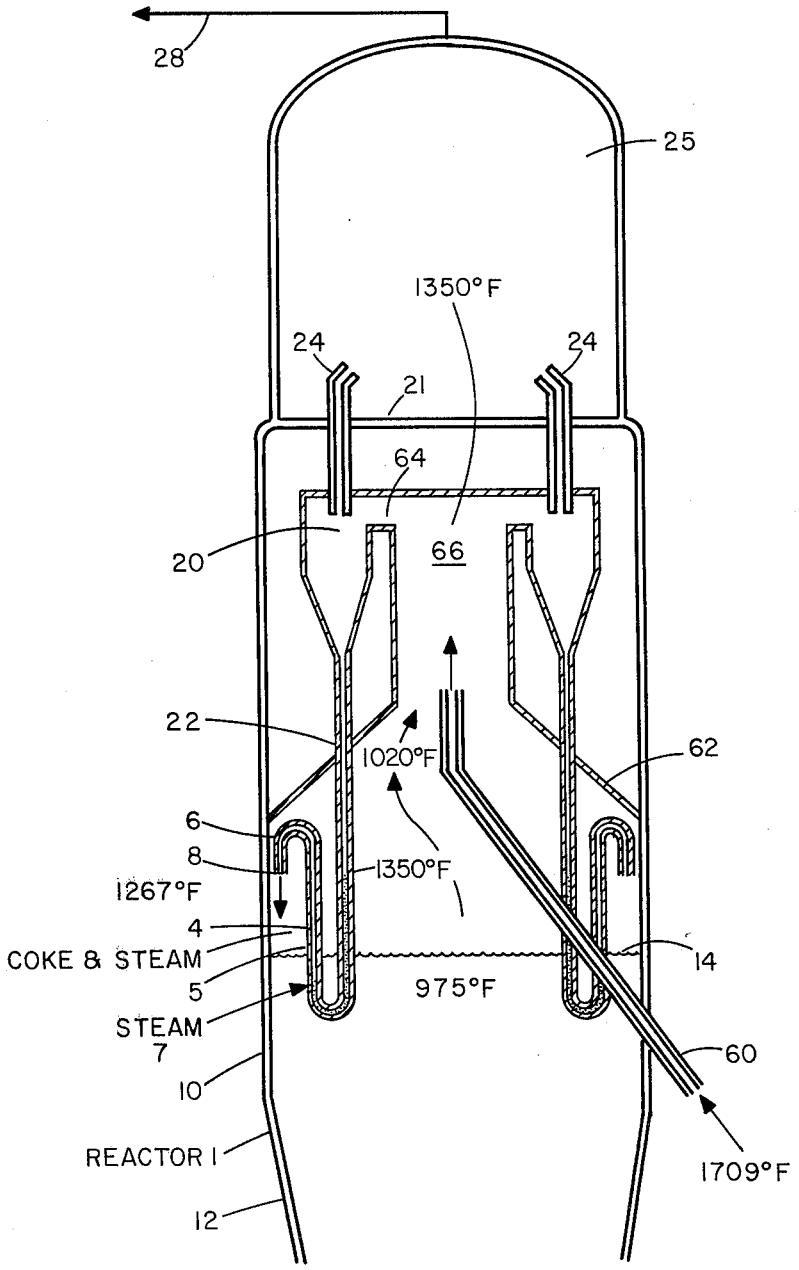
FIG. 2 is a more detailed schematic view of the upper portion of a co-cracking reactor. Like parts are designated by the same numbers as in FIG. 1.

The resulting cracked vapors leave the cyclones through line 24. Line 24 passes through a wall 21 separating the reactor from the scrubber 25 as shown in FIG. 2. The vapors leaving line 24 are quenched in the scrubber to about 600°-900° F. by liquid products from product fractionation. If desired, a stream of heavy material, viz., 950° F.+ products, condensed in the scrubber may be recycled to the coking reactor via line 26. Furthermore, if desired, a portion of the carbonaceous feed may be injected into the scrubber to provide an adequate volume to carry coke fines back to the coking zone. The cyclone conversion products are removed from scrubber 25 via line 28 for fractionation in a conventional manner. In heater 2, stripped coke from coking reactor 1 (commonly called cold coke) is introduced by line 18 to a fluid bed of hot coke having an upper level indicated at 30. The bed is partially heated by passing a hot fuel gas into the heater by line 32. Supplementary heat may be applied to the heater by coke circulating in line 34. The gaseous effluent of the heater, including entrained solids, passes through a cyclone which may be a first cyclone 36 and a second cyclone 38 wherein separation of the larger entrained solids occurs. The separated larger solids are returned to the heater bed via the respective cyclone diplegs. The heater gaseous effluent, which is a fuel gas, is removed from heater 2 via line 40. A portion of coke is removed from heater 2 and passed by line 44 to a gasification zone 46 in gasifier 3 in which is maintained a bed of fluidized coke having a level indicated at 48. If desired, a purge stream of coke may be removed from heater 2 by line 50.

The gasification zone is maintained at a temperature ranging from about 1500° to about 2000° F., preferably from about 1600° to about 1800° F., and a pressure ranging from about 5 to about 150 psig, preferably from about 10 to about 60 psig and more preferably from about 25 to about 45 psig. Steam by line 52 and an oxygen-containing gas such as air, commercial oxygen or air enriched with oxygen by line 54 are passed via line 56 into gasifier 3. The coke particles in the gasification zone and the steam and the oxygen-containing gas undergo an exothermic reaction which supplies heat for the process and produces a hydogen and carbon monoxide-containing fuel gas. The gasifier product fuel gas, which may further contain some entrained solids, is removed overhead from gasifier 3 by line 32 and introduced into heater 2 as previously described.

In one mode of operating the process, 40,770 barrels per day of fresh feed which is a vacuum residuum is admitted to the reactor 1 via line 10, and 93.4K lb/hr steam (K=1000) through line 16. A stream of 2407K lb/hr of 1709° F. coke particles in 50.0K lb/hr steam is introduced via line 60 above the level 14 of the dense fluidized bed into the dilute phase in the duct 66 leading to the cyclone inlet 64. Under prevailing conditions the coking bed temperature is 975° F. and the cyclone temperature is 1350° F. In FIG. 2, the temperatures prevailing at different parts of the reactor for this embodiment are shown but they are to be considered illustrative and not limiting. As shown, there is a temperature gradient between the level 14 of the coking bed and the entrance to the cyclone.

In this illustration 255K lb/hr of water that would have been introduced into the bed in the base case, is not added to the bed but instead is injected into the dipleg risers as steam at 450° F. The risers heat the steam and cool the coke to a temperature of 1267° F. or 292° F. above the bed temperature. The steam dilution to the second stage is therefore the same as in the base case but the steam at 450° F. to the bed has been reduced to the normal 15% on resid (93.4K lb/hr) used in regular coking. The steam which comes from the riser at 1267° F. mixes with the vapor and entrained coke from the bed at 975° F. and reaches an average temperature of 1020° F. This illustrates the heat savings since this mixture only has to be heated from this level, instead of from 975° F., up to steam cracking temperature by injected solids from the gasifier. The gasifier solids come into the duct 66 at 1709° F. They heat exchange with all the other materials in the dilute phase and raise them to 1350° F. at which cracking occurs. The gas and solids products, now all at 1350° F., pass into the cyclone. The separated solids, at this temperature, pass into the riser and heat exchange with the injected steam.

The reduced water to the bed reduces the volume of gas flow leaving the bed to 41% of the base case. This reduces the entrainment of coke from the bed from 1145K lb/hr to 474K lb/hr and reduces reactor diameter from 36 ft. to 24 ft. The reduced entrainment reduces the heat load on the second stage by 109 MBTU/hr (M=1 million) and superheating the vapors reduces the load on the second stage by an additional 24 MBTU/hr. The gasifier coke only has to supply 388.8 MBTU/hr as against 521.6 MBTU/hr for the base case.

The hydrocarbon partial pressure of the vapors from the bed is reduced from 13.8 psia to 5.5 psia as a result of dilution with the dipleg riser steam. The increased temperature and reduced HCPP will eliminate coking in the dilute phase upstream of the second stage by preventing condensation of heavy hydrocarbons. This is due to the lower maximum end point of the vapors from the bed compared to the base case and the reduction in dew point of vapors from 975° F. to 890° F. after dilution with hot steam.

The yield pattern for vacuum residuum will typically include at least about 15 weight percent $C_2$–$C_4$ olefins/diolefins, e.g., about 10% ethylene, about 7% propylene, about 4% $C_4$'s and substantial amounts of $C_5$-430° F., 430°–650° F. and 650°–950° F. fractions. A wide range of aromatics produced in the process will be found in the $C_{5+}$ products. Portions of the $C_{5+}$ products may be recycled to coking or to steam cracking to give increased yields of the $C_2$–$C_4$ olefins/diolefins.

Although the process has been described for simplicity assuming circulating coke as the fluidized medium, it is to be understood that the fluidized seed particles on which the coke is deposited may be silica, alumina, zirconia, magnesia, calcium oxide, alundum, mullite, bauxite or the like. The fluidized solids may or may not be catalytic in nature.

If desired, hydrocarbon such as heavy cycle gas oil may be injected in the riser to supplement steam and further cool the coke entering the lower bed. Heavy cycle gas oil is of interest for this purpose since it may be desirable to recycle this low value product to extinction in the cocracker by recycling the gas oil to the reactor.

The advantage of injecting the gas oil to the riser rather than to the bed is to provide a greater reduction in the temperature of the lower bed due to superheating the gas oil above the bed temperature. The gas oil may be injected as either a vapor or a liquid. Other recycle or extraneous feeds may be injected to the riser to give a similar effect.

Cocracking uses as fuel low cost coke produced in the process from vacuum residuum. Thus the inexpensive feed supplies both the feed and the fuel. In addition, the present improvement makes possible a further energy saving by using the high level heat content of the coke used in the steam cracking stage before the coke is degraded to a lower temperature.

Thus it has been shown that there is a substantial reduction in the heat load on the reactor owing to eliminating water injection to the bed, thus conservation of energy. Mitigation of coke on the walls and equipment in the dilute phase is another advantage of this invention.

What is claimed is:

1. In an integrated two stage coking and steam cracking process for the production of products including low molecular weight unsaturated hydrocarbons in which (a) a carbonaceous material is reacted in a reactor in a first stage coking zone containing a bed of fluidized solids wherein steam is present maintained at fluid coking conditions including a temperature in the range of about 950° F. to about 1150° F. to form a vaporous coking zone conversion product and coke, said coke depositing on said fluidized solids;

(b) said vaporous coking zone conversion product is passed with entrained solids into a dilute phase to a second stage reaction zone;

(c) hot solids at a sufficient temperature and in sufficient amount are introduced into said conversion product entering said second stage reaction zone to raise the conversion product to steam cracking temperatures within the range of 1200° F. to 1700° F. and supply the endothermic heat of reaction; and (d) solids are separated from product gas in a gas-solids separation zone, separated solids are passed to the coking zone and separated gas is quenched, the improvement which comprises:

(e) introducing relatively low temperature steam into contact with said separated solids before they enter the coking zone to superheat the steam and cool the solids, discharging the resulting mixture into the dilute phase wherein the cooled solids are passed into the coking zone.

2. The process according to claim 1 in which the gas-solids separation zone comprises at least one cyclone and the relatively low temperature steam is contacted with separated solids passing from the cyclone dipleg.

3. The process according to claim 1 in which the temperature of the hot solids introduced into the conversion product entering the second stage reaction zone is in the range of 1600° to 1800° F.

4. The process according to claim 1 in which the coking zone conversion product is steam cracked at temperatures within the range of about 1300° to 1500° F.

5. The process according to claim 1 in which the temperature in the coking zone is in the range of about 950° to about 1050° F.

6. The process according to claim 1 in which the carbonaceous material is a vacuum residuum.

7. In an integrated, two stage coking and steam cracking process for the production of products including low molecular weight unsaturated hydrocarbons in which (a) a carbonaceous material is reacted in a reactor in a first stage coking zone containing a bed of fluidized solids wherein steam is present maintained at fluid coking conditions including a temperature in the range of about 950° to about 1100° F. to form a vaporous coking zone conversion product and coke, said coke depositing on said fluidized solids;

(b) a portion of said solids with the coke deposition thereon is introduced into a heating zone maintained at a temperature of from about 1050° to about 1150° F.;

(c) a portion of solids from said heating zone is introduced into a fluid bed gasification zone maintained at a temperature in the range of about 1600° to about 1800° F.;

(d) said vaporous coking zone conversion product is passed with entrained solids into a dilute phase to a second stage reaction zone;

(e) a portion of hot solids is withdrawn from the gasification zone;

(f) said hot solids are brought into contact with said vaporous conversion product entering said second stage reaction zone to raise said conversion product to steam cracking temperatures within the range of about 1300° to 1500° F., solids are separated from product gas in a gas-solids separation zone, separated solids are passed to the coking zone and separated gas is quenched, the improvement which comprises:

(g) introducing relatively low temperature steam into contact with said separated solids before they enter the coking zone to superheat the steam and cool the solids, discharging the resulting mixture into the dilute phase wherein the cooled solids are passed into the coking zone.

8. The process according to claim 1 or 7 in which at least a portion of $C_{5+}$ products recovered is recycled either to the coking zone or to the second stage reaction zone.

9. The process according to claim 1 or 7 in which the gas-solids separation zone comprises at least one cyclone and the contacting of relatively low temperature steam with separated solids is effected in a riser on the cyclone dipleg.

* * * * *